United States Patent [19]

Tausch

[11] 4,135,576

[45] Jan. 23, 1979

[54] MULTIPLE POCKET MANDREL WITH FLUID BYPASS

[75] Inventor: Gilbert H. Tausch, Sugar Land, Tex.

[73] Assignee: Camco, Incorporated, Houston, Tex.

[21] Appl. No.: 866,584

[22] Filed: Jan. 3, 1978

[51] Int. Cl.[2] ..... E21B 23/02

[52] U.S. Cl. ..... 166/117.5

[58] Field of Search ..... 166/117.5, 117.6, 242

[56] References Cited

U.S. PATENT DOCUMENTS

| | | | |
|---|---|---|---|
| 3,874,445 | 4/1975 | Terral | 166/117.5 |
| 3,889,748 | 6/1975 | Tausch | 166/117.5 |
| 4,077,472 | 3/1978 | Gano | 166/242 X |

*Primary Examiner*—Stephen J. Novosad
*Assistant Examiner*—George A. Suchfield
*Attorney, Agent, or Firm*—Fulbright & Jaworski

[57] ABSTRACT

A multiple pocket mandrel for use in a well tubing having fluid bypass passageways in parallel with the pockets for increasing the fluid flow area through the mandrel. Preferably, the pockets are equally spaced about a central open bore of the mandrel and a fluid passageway is positioned between adjacent pockets. The mandrel may include an orienting sleeve about the open bore above the pockets with a second set of fluid passageways offset from the open bore for providing fluid bypass passageways around the orienting sleeve.

9 Claims, 5 Drawing Figures

Fig. 1C
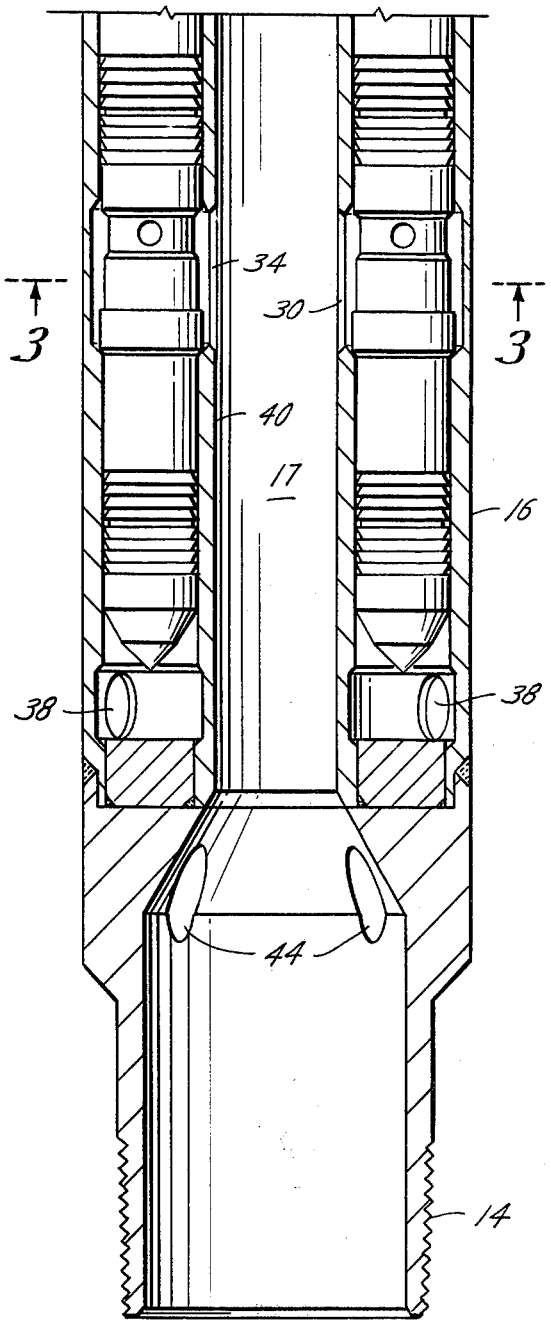
Fig. 2
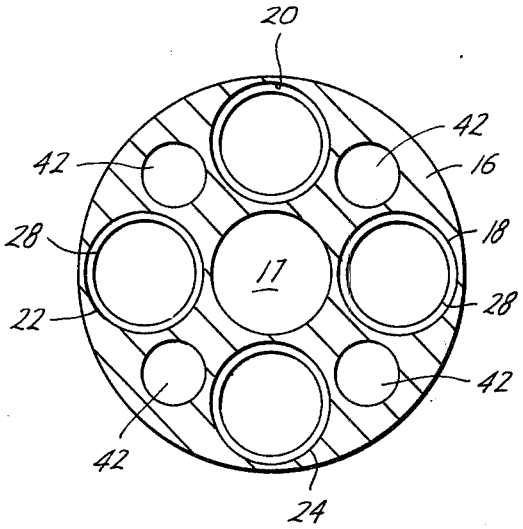
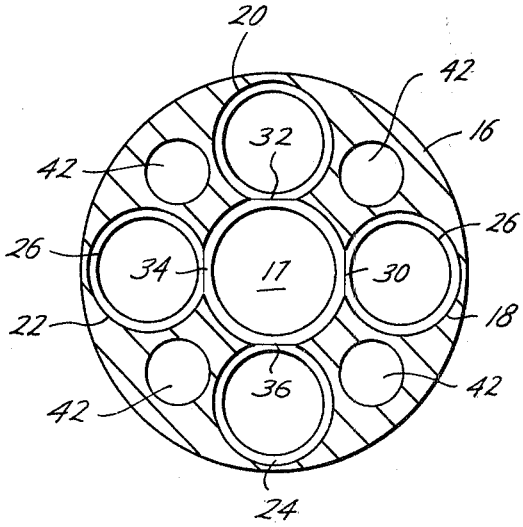
Fig. 3

MULTIPLE POCKET MANDREL WITH FLUID BYPASS

BACKGROUND OF THE INVENTION

The use of a mandrel having a plurality of pockets is disclosed in U.S. Pat. Nos. 3,874,445 and 3,889,748. While it is desirable to provide a mandrel having a plurality of pockets since a greater flow of control fluid may be provided through a plurality of pockets than through a single pocket, the addition of a plurality of pockets unduly restricts the size of the open bore through the mandrel since the size of the exterior of the mandrel is limited. In addition, it is preferable to utilize an orienting sleeve in the mandrel having a bore having an internal diameter of the same size as the bore through the pockets, which also decreases the amount of flow through the mandrel. The present invention is directed to an improved mandrel having bypass passageways for increasing the fluid flow through the mandrel so that the mandrel does not unduly restrict the fluid flow through the well tubing.

SUMMARY

The present invention is directed to a mandrel having a plurality of pockets offset from the open bore and a plurality of fluid bypass passageways offset from the open bore. The passageways have first and second ends with the first ends communicating with the open bore at a position adjacent the upper end of the pockets and the second ends communicating with the open bore at a position adjacent the lower end of the pockets for reducing the restriction of fluid flow through the mandrel caused by the plurality of pockets.

A further object of the present invention is the provision of a mandrel having an open bore which is coaxially positioned in the body of the mandrel and the pockets are equally spaced about the open bore and a fluid bypass passageway is positioned between adjacent pockets.

Still a further object of the present invention is the provision of an orienting sleeve positioned about the open bore above said pockets.

A still further object of the present invention is an orienting sleeve having an internal bore of the same size as the size of the open bore through the pockets and in which a plurality of second fluid bypass passageways are provided offset from the open bore and positioned about the orienting sleeve. The second passageways include first and second ends with the first ends of the second passageways communicating with the open bore adjacent the upper end of the orienting sleeve and the second ends of the second passageways communicating with the open bore adjacent the bottom end of the orienting sleeve thereby placing the second passageways in parallel to the restricted open bore through the orienting sleeve.

Yet a further object of the present invention is the provision of the mandrel body exterior being circular and the open bore of the mandrel body being coaxially positioned within the body.

Other and further features, and advantages will be apparent from the following description of the preferred embodiment.

BRIEF DESCRIPTION OF THE DRAWINGS

FIGS. 1A, 1B and 1C are continuations of an elevational view, partly in cross section, illustrating a mandrel of the present invention with valves inserted in two of the pockets, FIG. 2 is a cross-sectional view taken along the line 2—2 of FIG. 1B, and FIG. 3 is a cross-sectional view taken along the line 3—3 of FIG. 1C.

DESCRIPTION OF THE PREFERRED EMBODIMENT

Figure 1A:
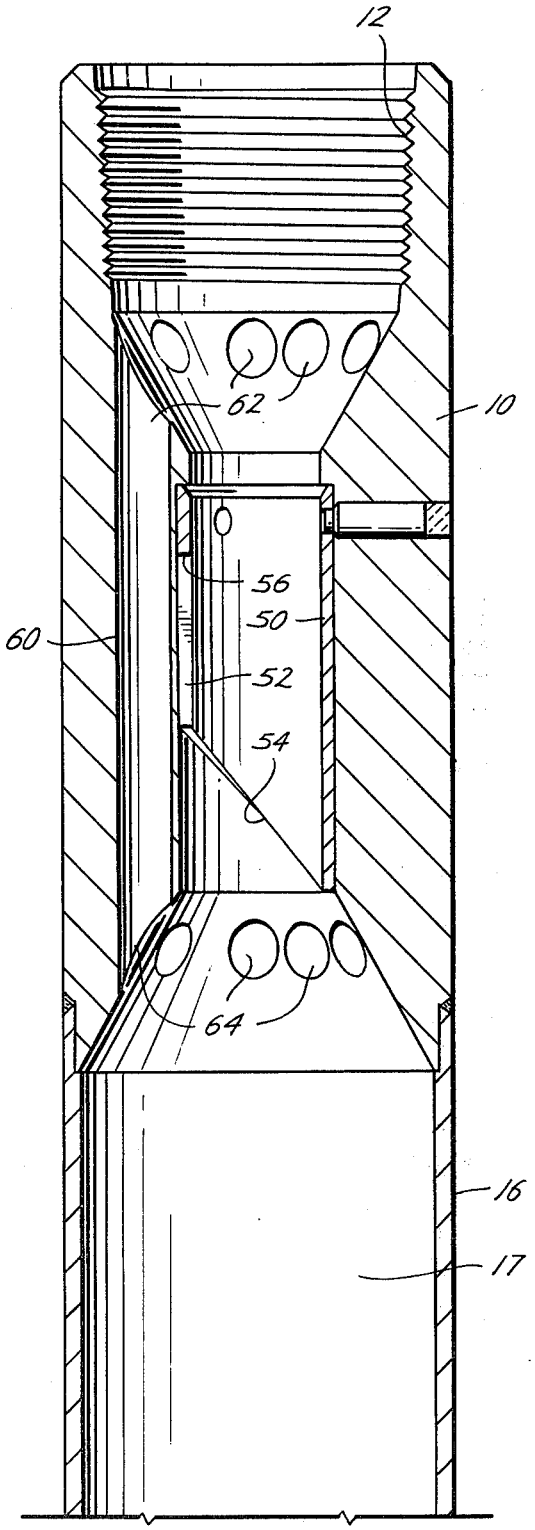
Figure 1B:
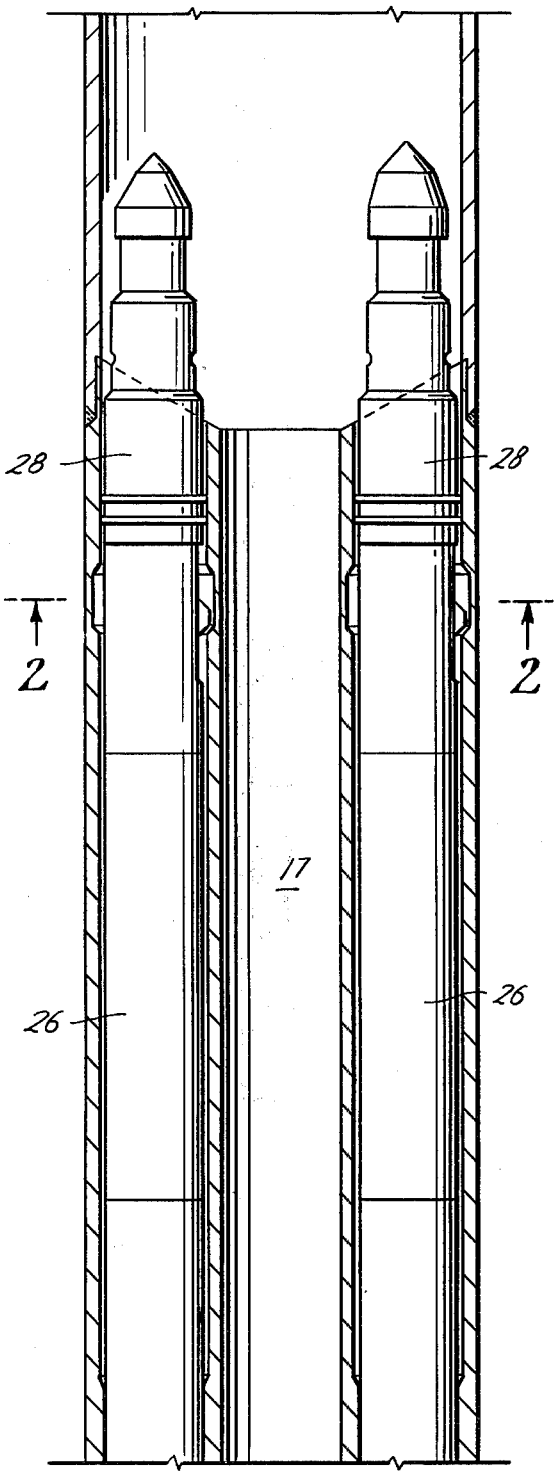

Referring now to the drawings, and particularly to FIGS. 1A, 1B and 1C, a mandrel 10 is shown having upper 12 and lower 14 threaded connections for connection in a well tubing. Preferably, the mandrel 10 includes a body 16 having an exterior which is circular and a main open bore 17 which is coaxially positioned within the body 16 for coaxial alignment with the bore of a well tubing. The body 16 includes a plurality of offset pockets, here shown for example only as four, 18, 20, 22 and 24 (FIGS. 2 and 3) for receiving a flow control device. Any suitable type of flow control device may be installed in the offset pockets. For example only, flow control devices 26 are shown installed in pockets 18 and 22 such as Camco Type R20 valves, and secured therein by Camco Type R latches 28.

Also for purposes of illustration only, as best seen in FIGS. 1C and 3, the pockets 18, 20, 22 and 24 include an opening 30, 32, 34 and 36, respectively, between each of the pockets and the bore 17 for communicating tubing gas to the valves 26, and as best seen in FIG. 1C, each pocket includes an opening 38 to the exterior of the mandrel body 16 whereby tubing gas may be transmitted through the valves 26 to the exterior of the mandrel 16. Of course, other and different porting configurations may be provided and various other types of control devices and latches may be utilized depending upon the particular use for the mandrel 10.

The outer dimensions of the cross-sectional area of the body 16 of the mandrel 10 is limited by the fact that the mandrel 10 is designed to be placed in a casing (not shown) in a well bore. In addition, the open bore 17 is required to be of a size to accommodate well tools moving through the well tubing. As indicated in U.S. Pat. No. 3,874,445, it is preferable to use a plurality of pockets instead of a single pocket as a larger volume of control fluid may be provided for performing various downhole operations. The present mandrel 10 preferably utilizes a central open bore 17 and provides a plurality of pockets, such as 18, 20, 22 and 24, which are equally spaced around the longitudinal axis of the bore 17. While such an arrangement provides a greater volume of fluid which can be controlled by the flow control devices in the pockets 18, 20, 22 and 24, the portion 40 of the open bore 17 passing through the pockets has a much smaller cross-sectional area than the open bore of the connected well tubing, thereby restricting the flow of well fluids through the well tubing.

One of the features of the present invention is the provision of a plurality of fluid bypass passageways 42 offset from the open bore 17 which increase the area for fluid flow through the mandrel 10. The fluid passageways 42 extend from the open bore 17 at a position adjacent the upper end of the pockets and have second ends 44 communicating with the open bore 17 at a position adjacent the lower end of the pockets whereby the passageways 42 form a bypass for increasing the fluid flow through the pocket section of the mandrel 10. Preferably, a fluid bypass passageway 42 is positioned between adjacent pockets.

Referring now to FIG. 1A, an orienting or guide sleeve 50 may be provided positioned aligned with the main bore 17 of the mandrel 10 and is preferably positioned above the offset pockets 18, 20, 22 and 24. The orienting sleeve may include a longitudinal guide slot 52, a helical guide surface 54 positioned below the slot 52 and directed inwardly and upwardly towards the bottom of the slot 52 for guiding and orienting a key of a suitable kickover tool into the slot 52, and an actuating shoulder 56 positioned at the top of the slot 52 for actuating a kickover tool for inserting and removing flow control devices from one or more of the pockets 18, 20, 22 and 24. Any suitable type of kickover tool such as that illustrated in U.S. Pat. No. 3,874,445 may be utilized.

While the orienting sleeve 50 may be positioned against the interior of the outer wall of the body 16, it is preferred that the internal diameter of the bore of the orienting sleeve 50 be approximately equal to and coaxially aligned with the bore portion 40 through the offset pockets for ease of operation with a kickover tool. However, with the cross-sectional size of the orienting sleeve 50 as illustrated in FIG. 1A, the bore 17 of the mandrel 10 through the sleeve 50 will be restricted and therefore a plurality of second fluid bypass passageways 60 are provided offset from the open bore 17 and positioned about the exterior of the orienting sleeve 50. The second passageways 60 have first ends 62 and second ends 64 similar to the first fluid passageways 42. The first ends 62 of the second passageways 60 communicate with the open bore 17 adjacent the upper end of the orienting sleeve 50 and the second ends 64 of the second passageways 60 communicate with the open bore 17 adjacent the bottom of the orienting sleeve 50. Therefore, the passageways 60 function as do the passageways 42 to increase the area for fluid flow through the mandrel body 16.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. A mandrel for use in a well tubing comprising, a mandrel body including upper and lower connecting means for connecting the mandrel in a well tubing, said body having an open bore therethrough for communication with the well tubing, a plurality of flow control device receiving pockets offset relative to the open bore, and a plurality of fluid passageways offset from the open bore, said passageways having first and second ends, the first ends communicating with the open bore at a position adjacent the upper end of the pockets and the second ends communicating with the open bore at a position adjacent the lower end of the pockets for increasing the area for fluid flow through the mandrel.

2. The apparatus of claim 1 wherein the pockets are equally spaced about the longitudinal axis of the open bore.

3. The apparatus of claim 2 wherein a fluid passageway is positioned between adjacent pockets.

4. The apparatus of claim 1 including, an orienting sleeve positioned about the open bore above said pockets.

5. The apparatus of claim 4 including, a plurality of second fluid passageways offset from the open bore and positioned about the orienting sleeve, said second passageways having first and second ends, said first ends of the second passageways communicating with the open bore adjacent the upper end of the orienting sleeve, and the second ends of the second passageways communicating with the open bore adjacent the bottom end of the orienting sleeve.

6. The apparatus of claim 1 wherein the mandrel body exterior is circular and the open bore is coaxially positioned within the body.

7. A mandrel for use in a well tubing comprising, a mandrel body including upper and lower connecting means for connecting the mandrel in a well tubing, said body having an open bore therethrough for communication with the well tubing, a plurality of flow control device receiving pockets offset relative to the open bore and equally spaced about the longitudinal axis of the open bore, a plurality of first fluid passageways offset from the open bore, said passageways having first and second ends, the first ends communicating with the open bore at a position adjacent the upper end of the pockets and the second ends communicating with the open bore at a position adjacent the lower end of the pockets, a first fluid passageway positioned between adjacent pockets, an orienting sleeve positioned about the open bore above said pockets, a plurality of second fluid passageways offset from the open bore and positioned about the orienting sleeve, said second passageways having first and second ends, said first ends of the second passageways communicating with the open bore adjacent the upper end of the orienting sleeve, and the second ends of the second passageways communicating with the open bore adjacent the bottom end of the orienting sleeve.

8. The apparatus of claim 7 wherein the mandrel body exterior is circular and the open bore is coaxially positioned within the body.

9. The apparatus of claim 7 wherein the diameter of the open bore through the orienting sleeve is the same as the diameter of the open bore through the pockets.

* * * * *